US011536501B2

(12) United States Patent
Li et al.

(10) Patent No.: US 11,536,501 B2
(45) Date of Patent: Dec. 27, 2022

(54) OIL SEPARATOR WITH INTEGRATED MUFFLER

(71) Applicant: CARRIER CORPORATION, Palm Beach Gardens, FL (US)

(72) Inventors: HongYi Li, Shanghai (CN); Yuling Shi, Shanghai (CN); Jin Liu, Shanghai (CN); Dongsheng Yang, Shanghai (CN); Yilin Zhang, Shanghai (CN); Xin Cheng, Shanghai (CN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 15/734,420

(22) PCT Filed: Sep. 3, 2019

(86) PCT No.: PCT/US2019/049317
§ 371 (c)(1),
(2) Date: Dec. 2, 2020

(87) PCT Pub. No.: WO2020/055626
PCT Pub. Date: Mar. 19, 2020

(65) Prior Publication Data

US 2021/0372675 A1 Dec. 2, 2021

(30) Foreign Application Priority Data

Sep. 14, 2018 (CN) ..... 201811073688.0

(51) Int. Cl.
*F25B 43/02* (2006.01)
*F25B 43/00* (2006.01)

(52) U.S. Cl.
CPC ..... *F25B 43/02* (2013.01); *F25B 43/003* (2013.01); *F25B 2500/12* (2013.01)

(58) Field of Classification Search
CPC .... F25B 43/02; F25B 43/003; F25B 2500/12; F25B 31/002; F25B 31/004; F25B 2500/16; F25B 2500/13; F24F 13/24
See application file for complete search history.

(56) References Cited

U.S. PATENT DOCUMENTS 4,282,717 A * 8/1981 Bonar, II ..... F25B 43/02 62/84
6,237,362 B1 5/2001 Jang
(Continued)

FOREIGN PATENT DOCUMENTS

CN 27892984 Y 5/2006
CN 201852379 U 6/2011
(Continued)

OTHER PUBLICATIONS

Pdf is translation of foreign reference CN104964494A (Year: 2015).*
(Continued)

*Primary Examiner* — Henry T Crenshaw
*Assistant Examiner* — Kamran Tavakoldavani
(74) *Attorney, Agent, or Firm* — Cantor Colburn LLP

(57) ABSTRACT

An oil separator and an air conditioning system provided with the oil separator are disclosed by the present disclosure. The oil separator comprises: an inlet (20) configured to receive a refrigerant; a duct (10) through which the refrigerant flows, the duct having a circumferential wall and comprising: a first section comprising a first muffler adjacent to the inlet, the first muffler (60) comprising a chamber (11) defined by a first wall (13) of the first section and designed to have a length dimension (L) in a length direction of the duct and a depth dimension (H) intersecting the length dimension; and a second section downstream of the first section, a second wall (23) of the second section being provided with a second muffler (70); and an oil separation assembly (80,90) through which the refrigerant passing
(Continued)

through the duct passes. The present disclosure has a simple and reliable structure and is easy to implement.

10 Claims, 2 Drawing Sheets

(56) References Cited

U.S. PATENT DOCUMENTS

| | | | | |
|---|---|---|---|---|
| 6,640,559 | B1 | 11/2003 | McQuade | |
| 7,181,926 | B2 | 2/2007 | Bhatia et al. | |
| 7,204,098 | B2 | 4/2007 | Yamada et al. | |
| 7,310,970 | B2 * | 12/2007 | Flanigan | F25B 43/02 62/85 |
| 7,708,537 | B2 | 5/2010 | Bhatia et al. | |
| 7,823,412 | B2 | 11/2010 | Jang et al. | |
| 7,856,837 | B2 | 12/2010 | Yamashita et al. | |
| 8,276,398 | B2 | 10/2012 | Grabon et al. | |
| 8,372,172 | B2 | 2/2013 | Murakami et al. | |
| 8,596,088 | B2 | 12/2013 | Sato | |
| 9,163,622 | B2 | 10/2015 | Sata et al. | |
| 9,651,036 | B2 | 5/2017 | Yamashita et al. | |
| 9,828,997 | B2 | 11/2017 | Kawano | |
| 2006/0280622 | A1 | 12/2006 | Lee et al. | |
| 2008/0034784 | A1 | 2/2008 | Schillemeit et al. | |
| 2008/0314063 | A1 | 12/2008 | Lifson et al. | |
| 2017/0045053 | A1 | 2/2017 | Ge | |
| 2018/0142689 | A1 | 5/2018 | Chen et al. | |
| 2020/0292220 | A1 * | 9/2020 | Kato | |

FOREIGN PATENT DOCUMENTS

| | | | | |
|---|---|---|---|---|
| CN | 201973971 | U | | 9/2011 |
| CN | 103567649 | A | | 2/2014 |
| CN | 203605557 | U | | 5/2014 |
| CN | 204627931 | U | | 9/2015 |
| CN | 104964494 | A | * | 10/2015 |
| CN | 204987588 | U | | 1/2016 |
| CN | 105588318 | A | | 5/2016 |
| CN | 104131963 | B | | 6/2016 |
| CN | 104359248 | B | | 8/2016 |
| CN | 103821723 | B | | 12/2016 |
| CN | 103659011 | B | | 1/2017 |
| CN | 104534751 | B | | 1/2017 |
| CN | 104266420 | B | | 2/2017 |
| DE | 225343 | A1 | | 7/1985 |
| EP | 1371919 | A2 | | 12/2003 |
| EP | 1888982 | B1 | | 12/2010 |
| EP | 2056952 | B1 | | 4/2017 |
| GB | 610000 | | | 10/1948 |
| JP | H09317671 | A | | 12/1997 |
| KR | 1020170062124 | A | | 6/2017 |
| WO | 2018091939 | A1 | | 5/2018 |

OTHER PUBLICATIONS

Attached pdf is translation of foreign reference CN 104964494 A (Year: 2015).*

International Search Report issued in Application No. PCT/US2019/049317 dated Oct. 30, 2019, 6 pages.

Written Opinion issued in Application No. PCT/US2019/049317 dated Oct. 30, 2019, 8 pages.

* cited by examiner

OIL SEPARATOR WITH INTEGRATED MUFFLER

CROSS REFERENCE TO RELATED APPLICATIONS

This application is a National Stage application of PCT/US2019/049317, filed Sep. 3, 2019, which claims the benefit of Chinese Application No. 201811073688.0, filed Sep. 14, 2018, both of which are incorporated by reference in their entirety herein.

FIELD OF THE INVENTION

The present disclosure relates to an oil separator. The present disclosure also relates to an air conditioning system provided with the oil separator.

BACKGROUND OF THE INVENTION

An air conditioning system includes a compressor, a condenser, an expansion valve, an evaporator, and the like. The compressor is configured to compress low-temperature low-pressure refrigerant gas to be high-temperature high-pressure refrigerant gas.

In practical use, a large amount of lubricating oil needs to be introduced into an interior of the compressor to prevent wear caused by friction between components of the compressor. When the refrigerant is compressed in the compressor, the lubricating oil introduced into the compressor is mixed with the refrigerant, which causes the compressed refrigerant to be discharged from the compressor together with the lubricating oil in the compressor. Therefore, in existing air conditioning systems, an oil separator is typically provided to separate the lubricating oil from the high-temperature high-pressure refrigerant gas and return it to the compressor.

In air conditioning systems, particularly in screw chillers, oil separator, compressor and fan coils are main sources of noise, and sometimes they determine the noise level of the screw chillers. In addition, the oil separator will produce louder and louder noises after being used for a period of time, affecting the acoustic performance of the entire air conditioning system.

SUMMARY OF THE INVENTION

One aspect of the present disclosure is to provide an oil separator having improved acoustic performance.

The oil separator comprises: an inlet configured to receive a refrigerant; a duct through which the refrigerant flows, the duct having a circumferential wall and comprising: a first section comprising a first muffler adjacent to the inlet, the first muffler comprising a chamber defined by a first wall of the first section and designed to have a length dimension in a length direction of the duct and a depth dimension intersecting the length dimension; and a second section downstream of the first section, a second wall of the second section being provided with a second muffler; and an oil separation assembly through which the refrigerant passing through the duct passes.

In the above oil separator, the first muffler comprises a separation plate disposed in the chamber in a direction of a flow path of the refrigerant.

In the above oil separator, the duct has a section, and the depth dimension is set to be larger than a geometrical dimension of the section such that the chamber forms at least one expansion chamber which extends radially from the wall of the duct in the first section.

In the above oil separator, the length dimension is set to correspond to a frequency band of the refrigerant to be resonated; and the expansion chamber is divided into a plurality of spaces each having a length dimension.

In the above oil separator, the second muffler comprises a porous structure formed on the second wall, the oil separator further comprises a sound absorbing material surrounding the second section, and the sound absorbing material comprises a fiber material such as glass fiber, a porous foam material, a woven wire mesh, or any combination of the above materials.

In the above oil separator, the sound absorbing material comprises a plurality of fiber mats arranged along the duct and stacked.

In the above oil separator, the oil separation assembly comprises a buffering plate in a direction of a flow path of the refrigerant, and the buffering plate is provided with holes, wherein a portion of the oil contained in the refrigerant is separated from the refrigerant after impinging on the buffering plate, and the refrigerant continues to pass through the holes.

In the above oil separator, the oil separation assembly further comprises a mesh structure made of a metal material and having pores for intercepting oil droplets in the refrigerant.

In the above oil separator, the duct and the inlet each have an axis in a same direction, and the refrigerant enters the oil separator along the axis; a radial dimension of the chamber is the depth dimension, and a distance from the first wall to the axis is greater than a distance from the second wall to the axis.

In the above oil separator, the duct and the inlet each have an axis in a same direction, and the refrigerant enters the oil separator along the axis; the chamber comprises: a first space, which is provided with a separation plate in a direction of a flow path of the refrigerant and having a first length dimension; a second space downstream of the first space, the second space having a second length dimension; and a connection passage between the first space and the second space, via which the refrigerant flows from the first space to the second space, a distance from the first wall to the axis is greater than a distance from the second wall to the axis.

Another aspect of the present disclosure is to provide an air conditioning system comprising a compressor, wherein the oil separator according to any one of the above described is disposed in a pipeline connecting to an outlet of the compressor or integrated onto an outlet of the compressor.

The oil separator according to the present disclosure comprises a first muffler and a second muffler. The oil separator can realize muffling at the same time of performing gas-oil separation for the refrigerant passing therethrough. The first muffler and the second muffler can muffle acoustic waves of different frequency bands of the refrigerant. The first muffler can be integrated into an existing oil separator, especially an oil separator including a second muffler, to muffle the low-frequency band acoustic energy in the refrigerant. The first muffler is arranged in the form of a resonant chamber at the inlet of the oil separator. The length and depth of the first muffler can be elaborately designed such that the resonant chamber acts as a reactive resonant muffler that reflects an incident pressure acoustic wave back, such as back to the compressor. The resonant chamber can greatly alleviate pressure pulsation in the oil separator. In particular, the designed resonant chamber can alleviate the pressure pulsation of the frequency band that the designer pays attention to, thereby reducing the acoustic energy radiated by the oil separator. What is particularly advantageous is that noise in a low-frequency range can be reduced.

In addition, by providing a separation device, the first muffler in the present disclosure can also collect large oil droplets before the refrigerant enters the sound absorbing material, thereby reducing the possibility that the oil droplets contaminate the sound absorbing material. The separation device is disposed in the resonant chamber of the first muffler to block the passage of large oil droplets. Therefore, the present disclosure can maintain good acoustic performance after a long period of operation.

The oil separator involved in the present disclosure is used in air conditioning systems, especially air-cooling systems. Tests have shown that the present disclosure can result in noise reduction at the level of a chiller. The present disclosure is more effective in terms of economics and performance as compared to wrapping a sound insulation material around the entire oil separator, thereby improving the performance of the chiller and the air conditioning system.

The oil separator of the present disclosure has a simple and reliable structure and is easy to implement.

Other aspects and features of the present disclosure will become apparent from the following detailed description with reference to the drawings. It should be understood, however, that the drawings are intended for purposes of illustration only, rather than defining the scope of the present disclosure, which should be determined with reference to the appended claims. It should also be understood that the drawings are merely intended to conceptually illustrate the structure and flowchart described herein, and it is not necessary to draw the figures to the scale, unless otherwise specified.

BRIEF DESCRIPTION OF THE DRAWINGS

The present disclosure will be more fully understood from the following detailed description of specific embodiments with reference to the drawings. Identical elements are denoted by identical reference signs throughout the drawings, wherein.

DETAILED DESCRIPTION OF THE EMBODIMENT(S) OF THE INVENTION

To help those skilled in the art precisely understand the subject matter of the present disclosure, specific embodiments of the present disclosure are described in detail below with reference to the accompanying drawings.

Figure 1:
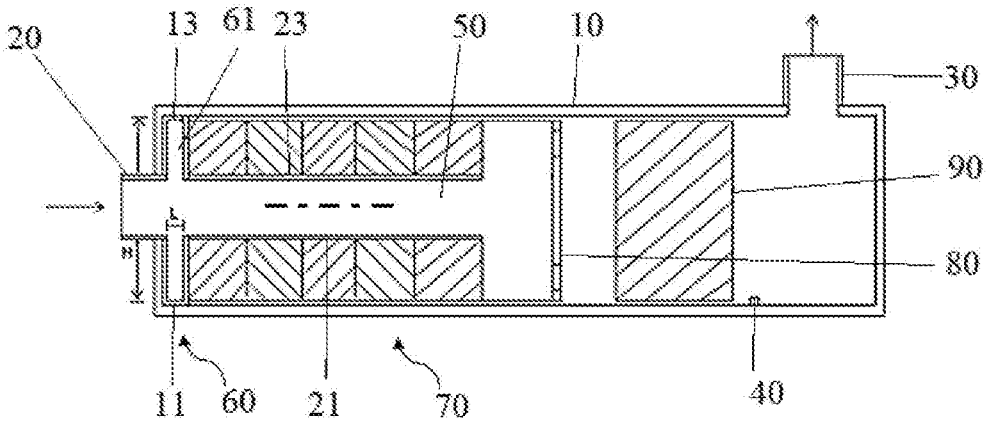
FIG. 1 is a schematic view of an embodiment of an oil separator according to the present disclosure.

FIG. 1 is a schematic view of an embodiment of an oil separator according to the present disclosure. As shown, the oil separator comprises a housing 10 having an inlet 20 at one end, and an outlet 30 and an oil discharge port 40 at the other end of the housing 10. The refrigerant which contains oil enters the interior of the housing from the inlet 20 and is discharged via the outlet 30 (see the direction of the arrow in the figure). Inside the housing 10, the oil in the refrigerant can be separated and discharged via the oil discharge outlet 40. In the illustrated embodiment, the outlet 30 is perpendicular to a direction in which the inlet 20 is disposed relative to the housing 10, i.e., the direction of discharging the refrigerant is at a right angle to the direction of introducing the same. It can be known that the outlet can also be disposed in other directions, and the arrangement thereof depends on the arrangement of the oil separator in the actual pipeline.

A duct 50 through which the refrigerant passes is disposed in the housing 10. The duct 50 has a wall in a circumferential direction. In the illustrated embodiment, the duct 50 has a circular section, and of course, the section may have a shape such as a rectangle, a square, and other shapes that can be anticipated by those skilled in the art. The duct 50 comprises a first section 11 and a second section 21. The wall of the first section 11 is a first wall 13, and the wall of the second section 21 is a second wall 23. A first muffler 60 is disposed in the first section 11, and a second muffler 70 is disposed in the second section 21. The refrigerant is denoised after passing through the first section 11 of the duct and is further denoised after passing through the second section 21 of the duct.

The first muffler 60 is disposed adjacent to the inlet 20, comprises a chamber 61 defined by the first wall 13, and has a length dimension L and a depth dimension H. The chamber 61 acts as a reactive resonant chamber, and the chamber having a variable section generates a resistant effect on the flow of the refrigerant gas passing through the section, so that the acoustic energy can be subjected to reflection, interference, transmission and the like, thereby reducing the reaction of radiating acoustic energy outwardly of the duct, and achieving the purpose of muffling. The first muffler 60 is designed according to the length dimension L and the depth dimension H, wherein the length dimension L is a dimension in the duct length direction and is also a dimension in the direction of the overall flow path of the refrigerant, and the depth dimension H is a dimension intersecting the length dimension L and is a radial distance of the first wall, and can also be understood as the lateral dimension in the direction of the section of the duct. For the illustrated embodiment, the radial dimension of the chamber 61 is represented by the depth dimension H, which is taken from the maximum radial distance of the first wall 13. The axial dimension of the chamber 61 is represented by the length dimension L. The depth dimension H can be set to be different from the geometrical dimension of the section of the duct such that the refrigerant undergoes a change in section as it passes through the duct, whereby the reflected portion of the acoustic energy is increased. The shape of the chamber may be the same as or different from the sectional shape of the duct. In the illustrated embodiment, the shape of the chamber is the same as the sectional shape of the duct, both of which are circular. The length dimension L can be designed according to the frequency band of the refrigerant that needs to be resonated. For example and without limitation, if the refrigerant passes through the second section of the duct for muffling of a particular frequency band, the length dimension L can be designed to muffle other frequency bands in the first section, or the designer selects the length dimension L such that it satisfies the resonance of the desired frequency band to be muffled.

Figure 2:
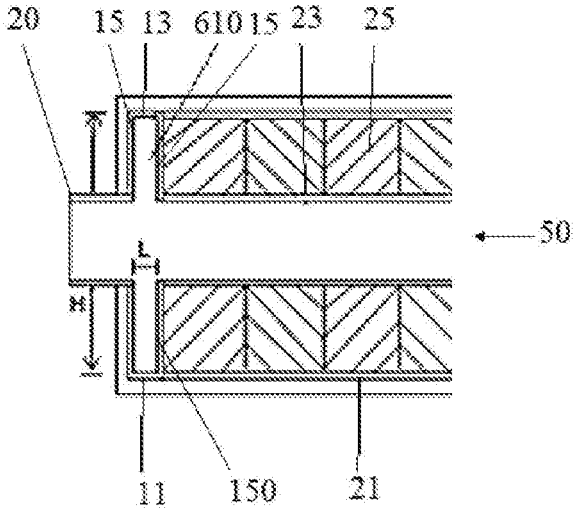
FIG. 2 is an enlarged view showing a portion of FIG. 1 with a first muffler.

FIG. 2 is a partially enlarged view of FIG. 1. It can be seen that the depth dimension H is designed to be larger than the geometrical dimension of the section of the duct such that the chamber is formed as an expansion chamber 610 that extends radially from the wall of the duct in the first section. For the expansion chamber 610, the first wall 13 defines a contour in the circumferential direction thereof, and two ends of the expansion chamber 610 in the axial direction are defined by third walls 15 extending radially from the duct 50. Thus, the radial dimension of the expansion cavity 610 is the depth dimension H, i.e., a radial distance of the first wall 13, and the axial dimension is the length dimension L, i.e., a distance between the two opposing third walls 15. When the refrigerant passes through the first section 11 of the duct, the gas flow of the refrigerant encounters a variable-section chamber that is abruptly enlarged in section, thereby effecting reactive muffling. The refrigerant passing through the duct 50 contains pressure pulsation generated due to intermittent air suction and exhaust of the compressor, and the pressure pulsation is the primary source of noise for the oil separator. The first muffler is placed adjacent to the inlet. In the illustrated embodiment, the inlet is in direct fluid communication with the fluid in the duct, and as the refrigerant gas flow enters the inlet and continues to flow along the duct, it firstly passes through the chamber having an enlarged section, and the acoustic energy is reflected within the chamber and returned to the compressor since the chamber is adjacent to the inlet.

A separation plate is disposed in the chamber, and the separation plate is configured to separate large oil droplets in the refrigerant impinging on the plate in the direction of the flow path of the refrigerant. The separation plate may be a component of the chamber or integrated with the chamber, such as via the third wall 15 on the rear end of the chamber shown in FIG. 2, namely a wall element 150; or may be a component separate from the chamber, for example and without limitation, a separation plate set at the center of the chamber, also at the center of the duct. As described above, the refrigerant from the compressor contains pressure pulsation waves, so when the refrigerant impinges on the separation plate with a large energy, the large oil droplets are blocked and forced to be separated from the refrigerant, thereby achieving the effect of initial separation.

Returning to FIG. 1, the inlet 20 is aligned with the direction of the duct 50, i.e., the inlet 20 has the same axis as the duct 50 (dotted line as shown in FIG. 1). The refrigerant does not need to be diverted when entering the inlet 20; instead, it enters the duct directly, passes through the first muffler 60 in the first section 11 firstly, and then passes through the second muffler 70 in the second section 21.

The second muffler 70 may be a muffler different from the first muffler 60 in the principle of muffling; by way of example and without limitation, the second muffler 70 is a resistive muffler.

With continued reference to FIG. 1, a distance from the first wall 13 to the axis of the duct is greater than a distance from the second wall 23 to said axis. A porous structure (not shown) is provided on the second wall 23. A sound absorbing material 25 surrounds the second wall 23 inside the housing. The sound absorbing material is, for example but not limited to, a fiber material such as glass fiber. As shown, the sound absorbing material is stacked on the second wall 23 of the second section 21 of the duct in a form of a plurality of fiber mats and wrapped around the second wall 23. The porous structure acts as a channel for the propagation of acoustic energy and protects the sound absorbing material. When the refrigerant reaches the second section 21, the acoustic energy enters the sound absorbing material through the pores, and is converted from acoustic energy into heat energy by friction and is dissipated, thus achieving muffling. The sound absorbing material may also be a porous foam material such as metal foam or foam plastic, and the sound absorbing material may also be a woven wire mesh or any combination of the above materials. It is contemplated that other forms of muffler may be provided in the second section 21 in place of the sound absorbing muffler as illustrated. In addition, the illustrated sound absorbing muffler has a good sound absorbing effect on the intermediate-frequency and the high-frequency sound waves, and therefore, a muffler for the low-frequency muffling can be designed in the first section 11. The length dimension L of the chamber 61 in the first section 11 is designed to enable low-frequency band muffling (i.e., reflecting pressure pulsation) for the refrigerant passing through the first section 11 of the duct, and enable intermediate-frequency band and high-frequency band muffling when the refrigerant passes through the second section 21 of the duct (i.e., the pressure pulsation is further reduced by energy dissipation).

For the design of an existing oil separator including a resistive muffler, the first muffler of the present disclosure can be added in front of the resistive muffler to achieve full-frequency band muffling of the refrigerant.

Disposing the separation plate in the first muffler to separate the large oil droplets from the refrigerant facilitates the reduction of contamination of the sound absorbing material by the oil droplets when the refrigerant enters the second muffler and the reduction of the damage to the performance of the second muffler.

An oil separation assembly is also disposed inside the housing 10. After passing through the first section 11 and the second section 21 of the duct, the refrigerant enters the oil separation assembly for gas-oil separation, the refrigerant after the separation exits via the outlet 30, and the separated oil is discharged via the oil discharge port 40.

Figure 3:
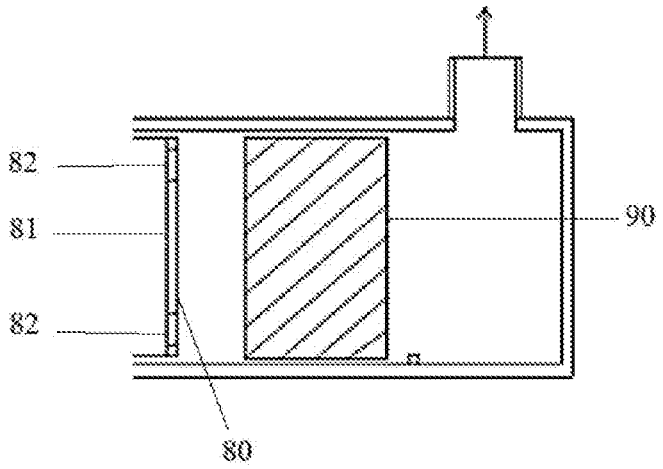
FIG. 3 is an enlarged view showing another portion of FIG. 1 with an oil separation assembly.

The oil separation assembly comprises a buffering plate 80 disposed at a rear end of the duct 50 inside the housing 10. As shown in FIG. 1, the buffering plate 80 is located at a distance from the rear end of the duct. FIG. 3 is a partially enlarged view of FIG. 1. As shown in FIG. 3, the buffering plate 80 comprises a buffering plate body 81 having a large area and located at the center, and a plurality of holes 82 disposed around the buffering plate body 81 for allowing a refrigerant gas flow to pass through. When the refrigerant moves to the buffering plate 80, it impinges on the buffering plate 80, at least a portion of the oil droplets are separated from the refrigerant due to the blocking of the buffering plate body 81, and the refrigerant after the separation passes through the buffering plate 80 via the plurality of holes 82.

The oil separation assembly further comprises a mesh structure 90. The mesh structure is made of a metal material such as a wire mesh. The mesh structure may be a metal plate with meshes, a metal ball made of clustering wires, or other shapes that can be contemplated by those skilled in the art. There are numerous small pores in the mesh structure. These small pores are sized to allow the gas flow to pass while the oil droplets cannot pass, so the oil droplets are intercepted.

The oil separation assembly may be a device including both the buffering plate 80 and the mesh structure 90 for separation as shown in the figure, or may include only the buffering plate 80 or only the mesh structure 90, or may not be limited to including the above-mentioned separation devices. For example, other separation devices may be added. In addition, the order in which the refrigerant passes through the buffering plate 80 and the mesh structure 90 is not limited to the order shown in the drawings, and the above order may be reversed, or may be sorted according to design requirements in the case where three or more separation devices are provided.

In addition, an oil passage may be designed on the side of the housing 10, and the oil passage may be connected to the above separation plate, the buffering plate and the mesh structure. The oil droplets intercepted on the separation devices are collected and guided to the oil discharge port 40 through the oil passage.

Figure 4:
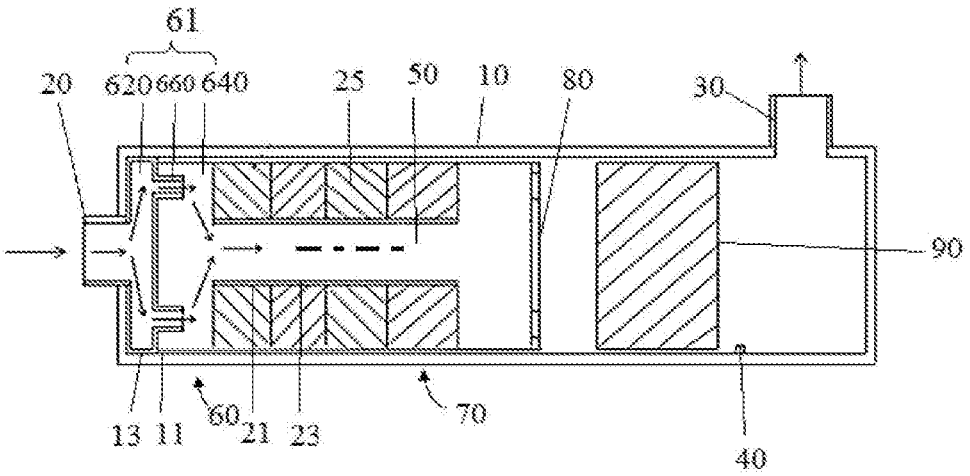
FIG. 4 is a schematic view of another embodiment of an oil separator according to the present disclosure.

FIG. 4 is a schematic view of another embodiment of the oil separator according to the present disclosure. In the illustrated embodiment, the second muffler and the oil separation assembly in the oil separator are substantially identical to those in FIG. 1 in terms of construction and function. The difference lies in the arrangement of the first muffler. As can be seen from the figure, the first muffler 60 is disposed adjacent to the inlet, and the direction of the inlet 20 is aligned with the direction of the duct 50. The first muffler 60 comprises a chamber 61 defined by the first wall 13, and the chamber 61 is divided into a plurality of spaces, including a first space 620 disposed adjacent to the inlet and a second space 640 adjacent to the first space 620. A connection passage 660 is disposed between the first space 620 and the second space 640, whereby the refrigerant passing through the first space 620 enters the second space 640 via the connection passage 660.

Figure 5:
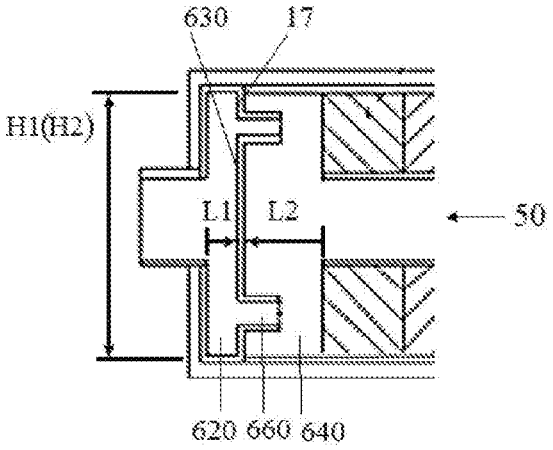
FIG. 5 is an enlarged view showing a portion of FIG. 4 with a first muffler.

FIG. 5 is an enlarged schematic view of the first muffler of FIG. 4. It can be seen from the illustrated embodiment that the chamber is divided into a plurality of spaces, which is equivalent to further dividing the chamber into a plurality of small chambers (i.e., spaces) having chamber bodies of different dimensions, thereby affecting acoustic energy of the refrigerant entering into the chambers. As can be seen from the figure, the connection passage 660 is a plurality of small passages attached to a rear end of the first space 620, and therefore, the refrigerant flowing into the duct 50 first passes through the first space 620 having an enlarged section chamber body, then passes through the connection passage 660 having a reduced section chamber body, and reaches the second space 640 having an enlarged section chamber body again. After experiencing the enlargement-reduction-enlargement of the section of the chamber body, the refrigerant gas flow is reflected for multiple times in these chamber bodies, and the acoustic energy of the gas flow is reduced. It is conceivable that the chamber can be divided into three spaces or even more spaces such that the refrigerant passing through the first muffler experiences a plurality of chamber bodies having varying sections.

Another significance of the design of the plurality of spaces of the chamber is that, as explained in connection with FIG. 4, the first space 620 has a first length dimension L1, the second space 640 has a second length dimension L2, and the first length dimension L1 may be designed to be different from the second length dimension L2 to increase the frequency bands of the refrigerant for which a resonance is desired. That is, according to the design concept, the gas flow of the plurality of frequency bands can be muffled by providing a plurality of spaces of different length dimensions.

Similarly, the first space 620 and the second space 640 may have the same depth dimension as shown in FIG. 5, or may be designed to have different depth dimensions according to design concepts, that is, the first space 620 has a first depth dimension H1, and the second space 640 has a second depth dimension H2.

In addition, the separation plate 630 may also be disposed in at least one of the spaces, and the separation plate 630 is configured to separate large oil droplets from the refrigerant impinging on the plate in the direction of the flow path of the refrigerant. As shown in FIG. 5, the first space 620 defines a space body by the first wall 13 and two opposing end walls. The rear end wall (shown by 17 in FIG. 5) of the two end walls is referred to herein as a fourth wall 17, which has a body of the separation plate 630 having a large area and located at the center. When large oil droplets in the refrigerant impinge on the separation plate 630, they are blocked and forced to be separated from the refrigerant. The other portion of the refrigerant passes through the connection passage 660 disposed around the body of the separation plate. The separation plate 630 may be a component of the space or may be integrated with the space, such as via the fourth wall 17 of the first space 620 shown in FIG. 5, or may be a component separate from the space. For example and without limitation, the central separation plate is set at the center of the duct, and also set at the center of the first space.

The oil separator involved in the present disclosure is used for a refrigerant, and is particularly suitable for a refrigerant with pressure pulsation. The oil separator involved in the present disclosure is also used in an air conditioning system, in particular an air-cooling system of an air conditioning system, and is disposed in a pipeline connecting to an outlet of the compressor or directly integrated onto an outlet of the compressor.

Principles of the present disclosure are described in connection with the specific embodiments of the present disclosure that have been shown and described in detail, but it should be understood that the present disclosure can be implemented in other ways without departing from the principles.

What is claimed is:

1. An oil separator, comprising:

an inlet configured to receive a refrigerant;

a duct through which the refrigerant flows, the duct having a circumferential wall and comprising:

a first section comprising a first muffler adjacent to the inlet, the first muffler comprising a chamber defined by a first wall of the first section and designed to have a length dimension in a length direction of the duct and a depth dimension intersecting the length dimension; and a second section downstream of the first section, a second circumferential wall of the second section being provided with a second muffler; and an oil separation assembly through which the refrigerant passing through the duct passes;

wherein the first muffler comprises a separation plate disposed in the chamber in a direction of a flow path of the refrigerant.

2. The oil separator according to claim 1, wherein the second muffler comprises a porous structure formed on a second wall, the oil separator further comprises a sound absorbing material surrounding the second section, and the sound absorbing material comprises a fiber material such as glass fibers, a porous foam material, a woven wire mesh, or any combination of the above materials.

3. The oil separator according to claim 2, wherein the sound absorbing material comprises a plurality of fiber mats arranged along the duct and stacked.

4. The oil separator according to claim 1, wherein the oil separation assembly comprises a buffering plate in a direction of a flow path of the refrigerant, and the buffering plate is provided with holes, wherein a portion of the oil contained in the refrigerant is separated from the refrigerant after impinging on the buffering plate, and the refrigerant continues to pass through the holes.

5. The oil separator according to claim 1, wherein the oil separation assembly further comprises a mesh structure made of a metal material and having pores for intercepting oil droplets in the refrigerant.

6. An air conditioning system, comprising a compressor, wherein an oil separator according to claim 1 is disposed in a pipeline connecting to an outlet of the compressor or integrated onto an outlet of the compressor.

7. An oil separator, comprising:

an inlet configured to receive a refrigerant;

a duct through which the refrigerant flows, the duct having a circumferential wall and comprising:

a first section comprising a first muffler adjacent to the inlet, the first muffler comprising a chamber defined by a first wall of the first section and designed to have a length dimension in a length direction of the duct and a depth dimension intersecting the length dimension; and a second section downstream of the first section, a second circumferential wall of the second section being provided with a second muffler; and an oil separation assembly through which the refrigerant passing through the duct passes;

wherein the duct has a section through which the refrigerant passes, and the depth dimension is set to be larger than a geometrical dimension of the section such that the chamber forms at least one expansion chamber which extends radially from the wall of the duct in the first section.

8. The oil separator according to claim 7, wherein the length dimension of the chamber is set to correspond to a frequency band of the refrigerant to be resonated; and the expansion chamber is divided into a plurality of spaces each having a length dimension.

9. An oil separator, comprising:

an inlet configured to receive a refrigerant;

a duct through which the refrigerant flows, the duct having a circumferential wall and comprising:

a first section comprising a first muffler adjacent to the inlet, the first muffler comprising a chamber defined by a first wall of the first section and designed to have a length dimension in a length direction of the duct and a depth dimension intersecting the length dimension; and a second section downstream of the first section, a second circumferential wall of the second section being provided with a second muffler; and an oil separation assembly through which the refrigerant passing through the duct passes;

wherein the duct and the inlet each have an axis in a same direction, and the refrigerant enters the oil separator along the axis; a radial dimension of the chamber is the depth dimension, and a distance from the first wall to the axis is greater than a distance from the second wall to the axis.

10. An oil separator, comprising:

an inlet configured to receive a refrigerant;

a duct through which the refrigerant flows, the duct having a circumferential wall and comprising:

a first section comprising a first muffler adjacent to the inlet, the first muffler comprising a chamber defined by a first wall of the first section and designed to have a length dimension in a length direction of the duct and a depth dimension intersecting the length dimension; and a second section downstream of the first section, a second circumferential wall of the second section being provided with a second muffler; and an oil separation assembly through which the refrigerant passing through the duct passes;

wherein the duct and the inlet each have an axis in a same direction, and the refrigerant enters the oil separator along the axis; the chamber comprises:

a first space, which is provided with a separation plate in a direction of a flow path of the refrigerant and having a first length dimension;

a second space downstream of the first space, the second space having a second length dimension; and a connection passage between the first space and the second space, via which the refrigerant flows from the first space to the second space, a distance from the first wall to the axis is greater than a distance from the second wall to the axis.

* * * * *